US010227674B2

(12) United States Patent
Mizutani et al.

(10) Patent No.: US 10,227,674 B2
(45) Date of Patent: Mar. 12, 2019

(54) FERRITIC STAINLESS STEEL FOIL AND METHOD FOR PRODUCING THE SAME

(71) Applicant: JFE STEEL CORPORATION, Tokyo (JP)

(72) Inventors: Akito Mizutani, Chiba (JP); Mitsuyuki Fujisawa, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 99 days.

(21) Appl. No.: 15/302,386

(22) PCT Filed: Feb. 24, 2015

(86) PCT No.: PCT/JP2015/000910
§ 371 (c)(1),
(2) Date: Oct. 6, 2016

(87) PCT Pub. No.: WO2015/155920
PCT Pub. Date: Oct. 15, 2015

(65) Prior Publication Data

US 2017/0029916 A1 Feb. 2, 2017

(30) Foreign Application Priority Data

Apr. 8, 2014 (JP) ..... 2014-079087

(51) Int. Cl.
*C21D 9/46* (2006.01)
*C22C 38/50* (2006.01)
(Continued)

(52) U.S. Cl.
CPC ..... *C21D 9/46* (2013.01); *C21D 1/76* (2013.01); *C21D 6/002* (2013.01); *C21D 6/004* (2013.01);
(Continued)

(58) Field of Classification Search
CPC .... C21D 1/76; C21D 2211/005; C21D 6/002; C21D 6/004; C21D 6/005; C21D 6/008;
(Continued)

(56) References Cited

U.S. PATENT DOCUMENTS 4,318,828 A 3/1982 Chapman
4,414,023 A 11/1983 Aggen
(Continued)

FOREIGN PATENT DOCUMENTS

CN 101541993 A 9/2009
EP 2123785 A1 11/2009
(Continued)

OTHER PUBLICATIONS

International Search Report and Written Opinion for International Application No. PCT/JP2015/000910, dated Apr. 28, 2015, 6 pages.
(Continued)

*Primary Examiner* — Veronica F Faison
(74) *Attorney, Agent, or Firm* — Ratnerprestia

(57) ABSTRACT

Provided is a ferritic stainless steel foil having an excellent ability to form whiskers is obtained by its composition containing, by mass, C: 0.050% or less, Si: 2.00% or less, Mn: 0.50% or less, S: 0.010% or less, P: 0.050% or less, Cr: 15.0% or more and 30.0% or less, Al: 2.5% or more and 6.5% or less, N: 0.050% or less, one or more elements selected from Ti: 0.01% or more and 0.50% or less, Nb: 0.01% or more and 0.20% or less, V: 0.01% or more and 0.20% or less, Zr: 0.005% or more and 0.200% or less, and Hf: 0.005% or more and 0.200% or less, and the balance being Fe and inevitable impurities, the proportion of a {111} crystal grain (a crystal grain such that the difference between the {111} plane of the crystal grain and a direction perpendicular to the surface of the foil falls within ±15°) on the surface of the foil being 50% by area or more, and the
(Continued)

thickness of an oxide layer formed on the surface of the foil being 0.1 μm or less.

8 Claims, 2 Drawing Sheets

(51) Int. Cl.

| | |
|---|---|
| ***C21D 1/76*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(52) U.S. Cl.
CPC ..... *C21D 6/005* (2013.01); *C21D 6/008* (2013.01); *C21D 8/0205* (2013.01); *C21D 8/0226* (2013.01); *C21D 8/0236* (2013.01); *C21D 8/0268* (2013.01); *C21D 8/0273* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/005* (2013.01)

(58) Field of Classification Search
CPC .. C21D 8/0205; C21D 8/0226; C21D 8/0236; C21D 8/0268; C21D 8/0273; C21D 9/46; C22C 38/00; C22C 38/001; C22C 38/002; C22C 38/005; C22C 38/02; C22C 38/04; C22C 38/06; C22C 38/34; C22C 38/42; C22C 38/44; C22C 38/46; C22C 38/48; C22C 38/50
See application file for complete search history.

(56) References Cited

U.S. PATENT DOCUMENTS

| | | | | |
|---|---|---|---|---|
| 2002/0172613 | A1 | 11/2002 | Fukuda | |
| 2009/0280350 | A1* | 11/2009 | Inaguma | C21D 8/0226 428/609 |
| 2015/0299833 | A1* | 10/2015 | Mizutani | C22C 38/54 428/606 |
| 2016/0079455 | A1* | 3/2016 | Hatano | H01L 31/03923 136/252 |
| 2017/0275725 | A1* | 9/2017 | Mizutani | C21D 9/46 |

FOREIGN PATENT DOCUMENTS

| | | | | |
|---|---|---|---|---|
| JP | 5771898 | | 5/1982 | |
| JP | 58177437 | | 10/1983 | |
| JP | 62149862 | | 7/1987 | |
| JP | 0350199 | | 3/1991 | |
| JP | 0543984 | | 2/1993 | |
| JP | 062075 | A | 1/1994 | |
| JP | 07316746 | | 12/1995 | |
| JP | 2002194507 | A | 7/2002 | |
| JP | 2003105506 | | 4/2003 | |
| JP | 2003155543 | A | 5/2003 | |
| JP | 2004269915 | | 9/2004 | |
| JP | 2006009119 | | 1/2006 | |
| JP | 2009235555 | A | 10/2009 | |
| JP | 2011032524 | A | 2/2011 | |
| JP | 2011063833 | | 3/2011 | |
| WO | 0202836 | | 1/2002 | |
| WO | WO-2014097562 | A1 * | 6/2014 | C22C 38/00 |

OTHER PUBLICATIONS

Korean Office Action for Korean Application No. 10-2016-7030902, dated Dec. 15, 2017, including Concise Statement of Relevance of Office Action, 5 pages.
Chinese Office Action for Chinese Application No. 201580018207.4, dated Jun. 28, 2017, including Concise Statement of Search Report, 9 pages.
Supplemental European Search Report for Application No. 15777096.7, dated Mar. 10, 2017, 6 pages.
European Communication for European Application No. 15 777 096.7, dated Mar. 28, 2018, 4 pages.

* cited by examiner

FERRITIC STAINLESS STEEL FOIL AND METHOD FOR PRODUCING THE SAME

CROSS REFERENCE TO RELATED APPLICATIONS

This is the U.S. National Phase application of PCT/JP2015/000910, filed Feb. 24, 2015 and claims priority to Japanese Patent Application No. Ser. 2014-079087, filed Apr. 8, 2014, the disclosures of these applications being incorporated herein by reference in their entireties for all purposes.

FIELD OF THE INVENTION

The present invention relates to a ferritic stainless steel foil having an excellent ability to form $Al_2O_3$ whiskers and a method for producing the ferritic stainless steel foil. The present invention particularly relates to a ferritic stainless steel foil suitably used as a material of a catalyst carrier, e.g., for exhaust gas purifying facilities included in automobiles, agricultural machinery, construction machinery, industrial machinery, and the like and a method for producing the ferritic stainless steel foil.

BACKGROUND OF THE INVENTION

Ceramic honeycombs and metal honeycombs composed of a stainless steel foil have been widely used as a material of a catalyst carrier for exhaust gas purifying facilities included in automobiles, agricultural machinery, construction machinery, industrial machinery, and the like. Among the above honeycombs, recently, metal honeycombs have been increasingly used because metal honeycombs allow a higher aperture ratio to be achieved and have higher resistance to thermal shock and higher vibration resistance than ceramic honeycombs.

Metal honeycombs have a honeycomb structure formed by, for example, stacking a flat stainless steel foil and a stainless steel foil that has been worked into a corrugated shape alternately. A metal honeycomb including a catalytic material deposited on the surfaces of the stainless steel foils is used in an exhaust gas purifying device. For depositing a catalytic material on the surfaces of the stainless steel foils, commonly, the stainless steel foils are coated with $\gamma$-$Al_2O_3$ in order to form a wash coat layer on the stainless steel foils and a catalytic material such as Pt or Rh is carried by the wash coat layer.

Since metal honeycombs are exposed to a high-temperature exhaust gas, a stainless steel foil used as a material of metal honeycombs is required to have excellent oxidation resistance. A stainless steel foil used as a material of metal honeycombs is also required to have excellent adhesion (catalyst coating adhesion) to a catalyst coat (i.e., wash coat).

In order to achieve the above-described properties, recent metal honeycombs commonly composed of a high-Al-content ferritic stainless steel foil such as a 20 mass % Cr-5 mass % Al ferritic stainless steel foil or a 18 mass % Cr-3 mass % Al ferritic stainless steel foil. These foils have excellent oxidation resistance because, when the foils are exposed to a high temperature, a protective Al oxide layer mainly composed of $\alpha$-$Al_2O_3$ is formed on the surfaces of the foils. Furthermore, when these foils are subjected to a specific heat treatment, acicular microcrystals, which are referred to as "$\gamma$-$Al_2O_3$ whiskers" (hereinafter, may be referred to simply as "whiskers"), are formed on the surfaces of the foils, which increase the catalyst coating adhesion. For example, Patent Literature 1 proposes a technique in which the surface of an Al-containing ferritic stainless steel is oxidized by being heated in a low-oxygen atmosphere having a partial pressure of oxygen of 0.75 Torr (99.99 Pa) or less in order to form a whisker-precursor oxide film and the resulting Al-containing ferritic stainless steel is further oxidized in an oxidizing atmosphere in order to grow whiskers on the whisker-precursor oxide film.

FIG. 1 illustrates a result of observing the surface of a ferritic stainless steel foil by a scanning electron microscope, the ferritic stainless steel foil containing, by mass, C: 0.005%, Si: 0.15%, Mn: 0.15%, P: 0.03%, S: 0.002%, Cr: 20.0%, Ni: 0.15%, Al: 5.4%, Cu: 0.1%, N: 0.005%, and the balance being Fe and inevitable impurities which has been subjected to a heat treatment which holds the foil at 900° C. for 30 seconds in a vacuum of $2\times10^{-3}$ Pa and subsequently subjected to another heat treatment which holds the foil at 900° C. for 24 hours in an oxidizing atmosphere. FIG. 1 confirms the presence of acicular or tabular whiskers formed on the surface of the foil. The formation of whiskers increases the surface area of the foil and accordingly increases the area of contact with a catalyst coat. Further, since the whiskers are acicular or tabular in shape, they also have an effect to anchor the catalyst coat layer. Therefore, forming whiskers on the surface of a ferritic stainless steel foil increases the catalyst coating adhesion.

However, in the above technique proposed in the related art, it is necessary to perform an oxidative heat treatment for a long period of time, that is, about 24 hours, in order to grow whiskers having a sufficient length over the entire surface of the foil. This increases the production cost. A known method for addressing the above issue and forming whiskers in a shorter period of time is a method in which formation of whiskers is promoted by performing a pretreatment.

For example, Patent Literature 2 proposes a method in which blasting is performed as a pretreatment prior to an oxidative heat treatment performed for forming whiskers. It is described in Patent Literature 2 that forming a surface-deformed layer on an Al-containing ferritic stainless steel foil by blasting enables whiskers to be formed on the surface of the foil easily with effect.

Patent Literature 3 proposes a method in which a ferritic stainless steel containing 10% to 30% Cr and 6% to 20% Al is subjected to an heat pretreatment in which the steel is heated to 400° C. to 600° C. in an air atmosphere in order to form $\theta$-$Al_2O_3$ on the surface of the steel and the resulting steel is heated to 850° C. to 975° C. in order to grow whiskers. It is described in Patent Literature 3 that forming $\theta$-$Al_2O_3$ on the surface of the steel by the heat pretreatment enables whiskers having a high aspect ratio to be uniformly formed on the surface of the steel when a heat treatment is performed in the subsequent step.

PATENT LITERATURE

PTL 1: Japanese Unexamined Patent Application Publication No. 57-71898

PTL 2: Japanese Unexamined Patent Application Publication No. 62-149862

PTL 3: Japanese Unexamined Patent Application Publication No. 3-50199

SUMMARY OF THE INVENTION

The technique proposed in Patent Literature 2, that is, the technique in which blasting is performed as a pretreatment, includes an additional step other than the ordinary foil-rolling steps. Thus, an increase in the production cost still remains unaddressed. In the technique proposed in Patent Literature 3, the Al content in the ferritic stainless steel needs to be 6% to 20%, and in reality, the Al content needs to be 7.5% or more in order to achieve a sufficiently high ability of the steel to form whiskers (see Examples in Patent Literature 3). Ferritic stainless steels containing Al in such a large amount become significantly brittle (deterioration of toughness). This leads to various difficulties such as a difficulty in producing the foil.

For the above-described reasons, a method for increasing the forming rate of whiskers on an Al-containing ferritic stainless steel foil without deterioration of the properties of the steel or an increase in the production cost has been required.

An object of the present invention is to address the above-described issues and to provide a ferritic stainless steel foil having an excellent ability to form whiskers and a method for producing the ferritic stainless steel foil.

In order to address the above-described issues, the inventors of the present invention conducted extensive studies of various factors that affect the ability of the Al-containing ferritic stainless steel foil to form whiskers and, as a result, found a correlation between the crystallographic orientation of grains present in the surface of the foil and the ability of the foil to form whiskers. The inventors conducted further studies and found that crystal grains having a specific crystallographic orientation have an excellent ability to form whiskers. Specifically, whiskers grow on {111} crystal grains in the surface of the foil at a higher rate than on other crystal grains in the surface of the foil.

A fundamental experiment conducted for confirming the correlation between the crystallographic orientation of grains in the surface of the foil and the ability of the foil to form whiskers is described below.

A ferritic stainless steel foil containing, by mass, C: 0.005%, Si: 0.15%, Mn: 0.15%, P: 0.03%, S: 0.002%, Cr: 20.0%, Ni: 0.15%, Al: 5.4%, Cu: 0.1%, N: 0.005%, and the balance being Fe and inevitable impurities was subjected to a heat treatment which held the foil at 900° C. for 30 seconds in a vacuum of $2\times10^{-3}$ Pa and subsequently subjected to another heat treatment which held the resulting foil at 900° C. for 8 hours. The surface of the heat-treated foil was observed with a laser microscope (VK-X100 produced by Keyence Corporation). FIG. 2 illustrates the observation results (laser microscope image). The boundaries and crystallographic orientations of the crystal grains in the surface of the heat-treated foil were determined in the same field of view as that of the laser microscope image illustrated in FIG. 2 by electron backscatter diffraction (EBSD). The boundaries of the crystal grains which were determined from the measurement results are illustrated in FIG. 3 by the dotted lines. Further, FIG. 4 illustrates a result of conducting the three-dimensional geometry measurement by using the same laser microscope in the same field of view as that of the laser microscope image illustrated in FIG. 2.

The dark portions in FIGS. 2 and 3 are portions in which whiskers were present. The measurement conducted by electron backscatter diffraction (EBSD) confirms that the crystal grains marked with the arrow in FIG. 3 was {111} crystal grains and the other crystal grains were other than {111} crystal grain. Note that the term "{111} crystal grains" used herein refers to crystal grains such that the difference between the {111} plane of the crystal grains and a direction perpendicular to the surface of the foil falls within ±15°.

As illustrated in FIGS. 2 and 3, the darkness of the image, which indicates the presence of whiskers, is higher in the {111} crystal grain region than in the other regions. This confirms that whiskers were preferentially grown on {111} crystal grains in the surface of the foil. Furthermore, as illustrated in FIG. 4, the surfaces of {111} crystal grains, which are located at the center of the field of view, are higher in a direction perpendicular to the surfaces thereof than the surfaces of the other crystal grains. This confirms that whiskers grew on {111} crystal grains at a higher rate than on the other crystal grains. The reasons by which {111} crystal grains have an excellent ability to form whiskers are not clear; it is considered that the likelihood of matching of crystal lattices between {111} crystal grains and $\gamma$-$Al_2O_3$ whiskers formed on the surfaces of {111} crystal grains is high and $\gamma$-$Al_2O_3$ whiskers are likely to grow preferentially on {111} crystal grains.

From the results of the above-described experiment, it becomes clear that the ability of the foil to form whiskers is enhanced by increasing the proportion of {111} crystal grains on the surface of the foil. The inventors of the present invention further conducted detailed studies and found that, in order to form whiskers by performing a heat treatment for a short period of time, it is advantageous to set the proportion of {111} crystal grains on the surface of the foil to 50% by area or more.

Then, the inventors of the present invention studied a method for increasing the proportion (area proportion) of {111} crystal grains on the surface of an Al-containing ferritic stainless steel foil.

In general, stainless steel foils are produced by hot-rolling a slab to form a hot-rolled steel sheet, annealing the hot-rolled steel sheet, subsequently performing cold rolling or warm rolling (hereinafter, referred to simply as "cold rolling"), and annealing the cold-rolled steel sheet obtained by the cold rolling. In this case, commonly, the cycle of cold rolling and annealing is repeated due to restrictions by the capacity of the cold-rolling machine used. Hereinafter, an annealing treatment performed between cold rolling steps is referred to as "intermediate annealing", distinguished from the final annealing treatment which is referred to as "finishing annealing". For example, in the case where the cycle of cold rolling and annealing is repeated twice, the process is expressed as "cold rolling", "intermediate annealing", "cold rolling", and "finishing annealing".

The inventors of the present invention made foils under various rolling conditions and annealing (i.e., intermediate annealing and finishing annealing) conditions and studied the production conditions necessary for increasing the proportion of the area of {111} crystal grains on the surface of the foil. As a result, the inventors found that, in order to increase the area of {111} crystal grains, it is beneficial to introduce a large amount of strain caused by working to the foil before the foil is rolled to the thickness of the final product.

The inventors of the present invention also studied the composition of the steel which is optimal for increasing the proportion of the area of {111} crystal grains on the surface of the foil. As a result, the inventors found that setting the composition of the steel such that the C content is reduced to 0.050% by mass or less and is preferably reduced to 0.020% by mass or less and the content of one or more elements selected from Ti, Nb, V, Zr, and Hf is within a predetermined range and causing C to precipitate in the form of a carbide of these elements (one or more elements selected from Ti, Nb, V, Zr, and Hf) promote the development of {111} recrystallographic orientation. It was also found that setting the composition of the steel such that the content of one or more elements selected from Ti, Nb, V, Zr, and Hf is within a predetermined range further increases the forming rate of whiskers on the foil. This enables whiskers having a sufficient length to be formed on the surface of the foil even in the case where the amount of time during which a heat treatment (heat treatment in which the foil is maintained at a high temperature in an oxidizing atmosphere) is performed is markedly reduced compared with in the related art.

When a cold-rolled foil which has the above-described optimized composition and to which a large amount of strain caused by working has been introduced is annealed, the degree of accumulation of {111} crystal grains recrystallized by annealing is increased. This makes it possible to set the proportion of {111} crystal grains on the surface of the foil to 50% by area or more. In the case where the proportion of {111} crystal grains, on which whiskers are likely to preferentially grow, is 50% by area or more when the foil that has been subjected to finishing annealing is subjected to a whisker-forming heat treatment (heat treatment in which the foil is maintained at a high temperature in an oxidizing atmosphere), the amount of time required for the whisker-forming heat treatment may be reduced.

However, it was also found that whiskers may fail to be formed in the intended manner depending on the conditions under which finishing annealing is performed. Accordingly, the inventors of the present invention performed finishing annealing under various conditions and observed the surfaces of the resulting foils in order to study the influence of the properties of the surface of the foil that has been subjected to finishing annealing on the ability of the foil to form whiskers during the whisker-forming heat treatment. As a result, the inventors found that the thickness of an oxide layer formed on the surface of the foil that has been subjected to finishing annealing affects the ability of the foil to form whiskers and that, when the thickness of the oxide layer exceeds 0.1 μm, the negative influence of the oxide layer on the ability of the foil to form whiskers becomes apparent. It was also found that, in particular, it is possible to reduce the thickness of the oxide layer formed on the surface of the foil to 0.1 μm or less by optimizing the atmosphere (e.g., the degree of vacuum and dew point) in which finishing annealing is performed.

The present invention is based on the above findings. Aspects of the present invention are summarized as follows.

[1] A ferritic stainless steel foil having: a composition containing, by mass, C: 0.050% or less, Si: 2.00% or less, Mn: 0.50% or less, S: 0.010% or less, P: 0.050% or less, Cr: 15.0% or more and 30.0% or less, Al: 2.5% or more and 6.5% or less, N: 0.050% or less, one or more elements selected from Ti: 0.01% or more and 0.50% or less, Nb: 0.01% or more and 0.20% or less, V: 0.01% or more and 0.20% or less, Zr: 0.005% or more and 0.200% or less, and Hf: 0.005% or more and 0.200% or less, and the balance being Fe and inevitable impurities; a proportion of a {111} crystal grain on the surface of the foil being 50% by area or more; and thickness of an oxide layer formed on the surface of the foil being 0.1 μm or less, the {111} crystal grain being a crystal grain such that the difference between the {111} plane of the crystal grain and a direction perpendicular to the surface of the foil is within ±15°.

[2] The ferritic stainless steel foil described in [1], wherein the composition further contains, by mass, one or more elements selected from Ni: 0.01% or more and 0.50% or less, Cu: 0.01% or more and 1.00% or less, Mo: 0.01% or more and 4.00% or less, and W: 0.01% or more and 4.00% or less, the total content of the one or more elements being 6.0% or less.

[3] The ferritic stainless steel foil described in [1] or [2], wherein the composition further contains, by mass, one or more elements selected from Ca: 0.0005% or more and 0.0200% or less, Mg: 0.0002% or more and 0.0200% or less, and REM: 0.010% or more and 0.200% or less.

[4] A method for producing a ferritic stainless steel foil, the method including hot-rolling the slab described in any one of [1] to [3], performing cold rolling one or more times, and performing annealing one or more times, wherein the cold rolling is performed at a final rolling reduction of 50% or more and 95% or less, and wherein the annealing includes finishing annealing in which the foil is held at 800° C. or more and 1100° C. or less for 3 seconds or more and 25 hours or less in a low-oxygen atmosphere containing one or more gases selected from $N_2$, $H_2$, He, Ar, CO, and $CO_2$ and having a dew point of −20° C. or less or in a vacuum having a pressure of 1 Pa or less.

Note that the final rolling reduction is a rolling reduction at which a final cold rolling is performed, and the finishing annealing is a final annealing.

According to the present invention, a ferritic stainless steel foil on which whiskers can be formed in a short period of time, that is, a ferritic stainless steel foil having an excellent ability to form whiskers, is obtained without deteriorating the properties of the foil or increasing the production cost.

The ferritic stainless steel foil according to the present invention is suitably used as, for example, a material of a catalyst carrier for automobiles and motorcycles, a material of an external-cylinder member for such a catalyst carrier, a material of a pipe for mufflers for automobiles and motorcycles, or a material of exhaust pipes for heating appliance and combustion appliance. The ferritic stainless steel foil according to the present invention may also be used as, for example, a material of a catalyst carrier for exhaust gas purifying facilities included in agricultural machinery such as a tractor and a combine-harvester and construction machinery such as a bulldozer and a loading shovel, or a material of a catalyst carrier for industrial exhaust gas purifying facilities. However, the application of the ferritic stainless steel foil according to the present invention is not limited to the above examples.

DETAILED DESCRIPTION OF EMBODIMENTS OF THE INVENTION

Figure 1:
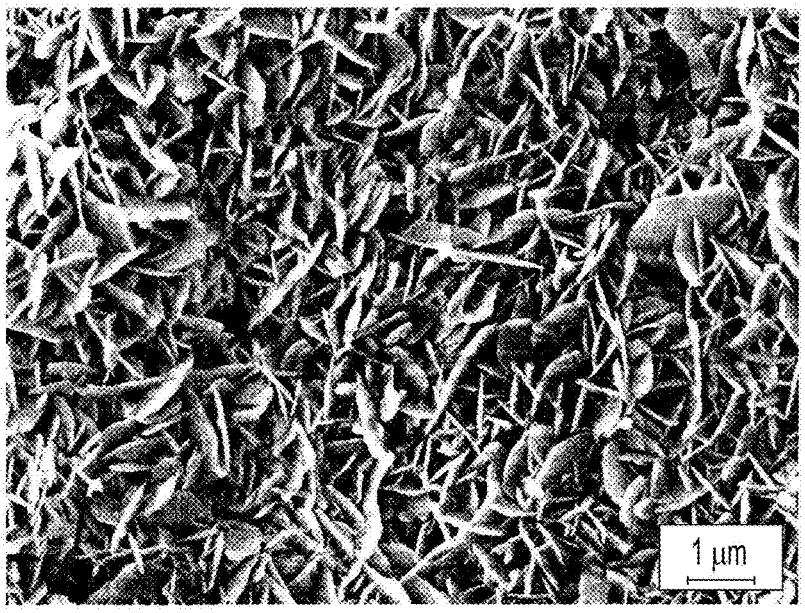
FIG. 1 is an example of a scanning electron microscope image of $Al_2O_3$ whiskers formed on the surface of a ferritic stainless steel foil.
Figure 2:
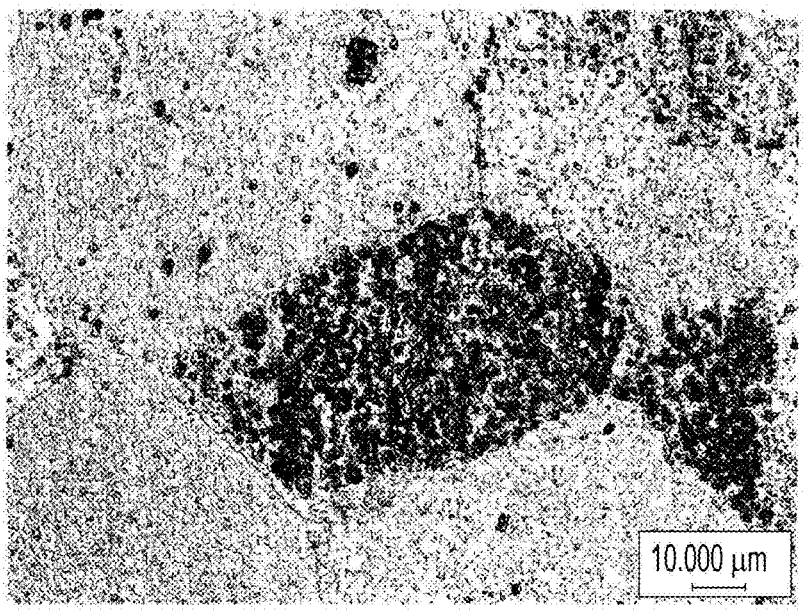
FIG. 2 is an example of a laser microscope image of the surface of a ferritic stainless steel foil that has been subjected to a heat treatment which holds the foil at 900° C. for 8 hours.
Figure 3:
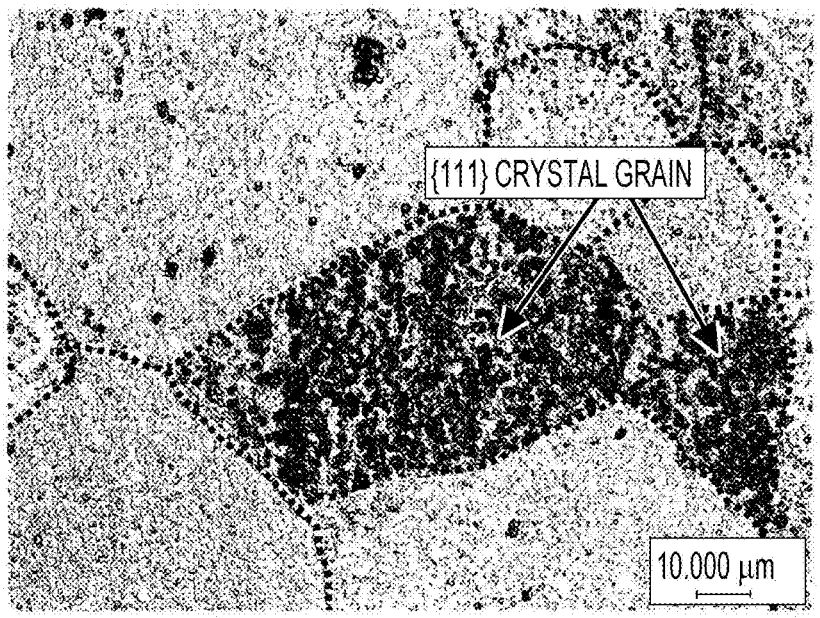
FIG. 3 is a diagram illustrating the result of determining the boundaries and crystallographic orientations of the crystal grains present in the surface of the heat-treated foil by electron backscatter diffraction (EBSD) in the same field of view as that of the laser microscope image illustrated in FIG. 2.
Figure 4:
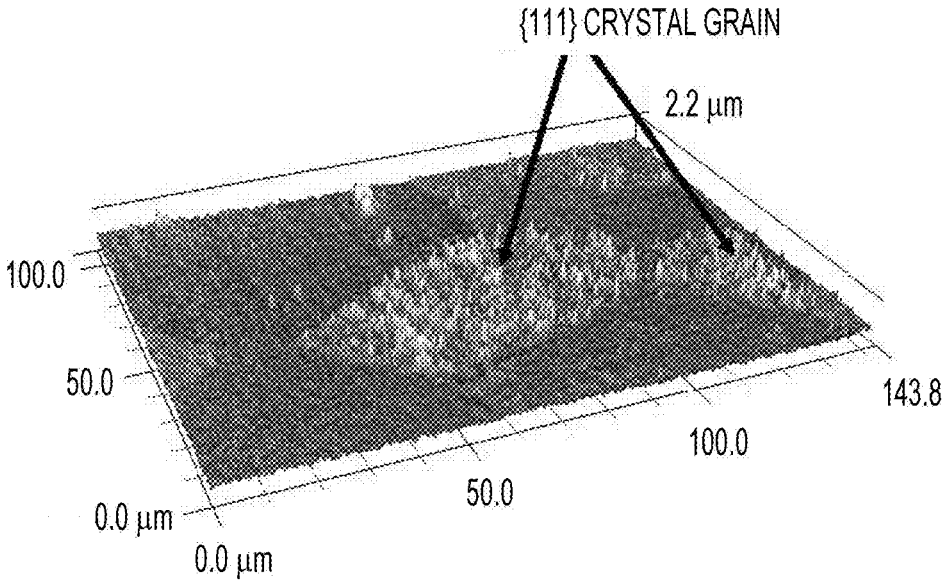
FIG. 4 is a diagram illustrating the result of determining the three-dimensional geometry of the surface of the heat-treated foil which is observed in the same field of view as that of the laser microscope image illustrated in FIG. 2.

Non-limiting aspects and embodiments of the present invention are described specifically below.

Note that the term "ferritic stainless steel foil" used herein refers to a foil that is composed of a ferritic stainless steel and has a thickness of 200 μm or less.

The reasons for limiting the compositions of the ferritic stainless steel foil according to aspects of the present invention are described below. Note that, when referring to a composition, "%" always denotes "mass %" unless otherwise specified.

C: 0.050% or Less

A C content exceeding 0.050% deteriorates the toughness of the slab, the hot-rolled sheet, the cold-rolled sheet, and the like and makes it difficult to produce the foil. Thus, the C content is preferably limited to be 0.050% or less. Further reducing the C content to 0.020% or less reduces the content of solute C in the steel and increases the proportion of the area of {111} crystal grains on the surface of the foil. Thus, the C content is more preferably set to 0.020% or less. However, reducing the C content to be less than 0.003% requires a large amount of time for refining and is disadvantageous from the viewpoint of productivity.

Si: 2.00% or Less

Si is an element effective for enhancing the oxidation resistance of the steel. In order to achieve the effect, the Si content is preferably set to 0.10% or more. However, a Si content exceeding 2.00% deteriorates the toughness of the hot-rolled sheet and makes it difficult to produce the foil. Thus, the Si content is preferably limited to be 2.00% or less, is more preferably set to 1.00% or less, and is more preferably set to be less than 0.20%. However, reducing the Si content to be less than 0.03% is difficult by a common refining method and requires a large amount of time and cost for refining if any. Thus, it is disadvantageous to set the Si content to be less than 0.03% from the viewpoint of productivity.

Mn: 0.50% or Less

A Mn content exceeding 0.50% deteriorates the oxidation resistance of the foil. Thus, the Mn content is preferably limited to be 0.50% or less, is more preferably set to 0.20% or less, and is further preferably set to be less than 0.10%. However, reducing the Mn content to be less than 0.03% is difficult by a common refining method and requires a large amount of time and cost for refining if any. Thus, it is disadvantageous to set the Mn content to be less than 0.03% from the viewpoint of productivity.

S: 0.010% or Less

A S content exceeding 0.010% reduces the adhesion between an Al oxide layer formed on the surface of the foil and the base iron, and also reduces the oxidation resistance of the foil at high temperatures. Thus, the S content is preferably limited to be 0.010% or less, is more preferably set to 0.0030% or less, and is more preferably set to 0.0010% or less.

P: 0.050% or Less

A P content exceeding 0.050% reduces the adhesion between an Al oxide layer formed on the surface of the foil and the base iron, and also reduces the oxidation resistance of the foil at high temperatures. Thus, the P content is preferably limited to be 0.050% or less and is more preferably set to 0.030% or less.

Cr: 15.0% or More and 30.0% or Less

Cr is an element essential for ensuring the oxidation resistance and the strength of the foil. In order to achieve such effects, the Cr content may be 15.0% or more. However, a Cr content exceeding 30.0% deteriorates the toughness of the slab, the hot-rolled sheet, the cold-rolled sheet, and the like and makes it difficult to produce the foil. Thus, the Cr content is preferably limited to be 15.0% or more and 30.0% or less. The Cr content is more preferably set to 17.0% or more and 25.0% or less and is more preferably set to 18.0 or more and 22.0% or less in consideration of the balance between the cost of the production of the foil and the properties of the foil at high temperatures.

Al: 2.5% or More and 6.5% or Less

Al is an important element in the present invention. The Al content is preferably 2.5% or more in order to form $Al_2O_3$ whiskers on the surface of the foil. The Al content also should be 2.5% or more to ensure the oxidation resistance of the foil. However, an Al content exceeding 6.5% deteriorates the toughness of the hot-rolled sheet and makes it difficult to produce the foil. Thus, the Al content is preferably limited to be 2.5% or more and 6.5% or less. The Al content is more preferably set to 3.0% or more and 6.0% or less, is more preferably set to 4.0% or more and less than 6.0%, and is further preferably set to 5.8% or less in consideration of the balance between the productivity of the foil and the oxidation resistance of the foil.

N: 0.050% or Less

A N content exceeding 0.050% deteriorates the toughness of the hot-rolled sheet and makes it difficult to produce the foil. Thus, the N content is preferably limited to be 0.050% or less and is preferably set to 0.030% or less. However, reducing the N content to be less than 0.003% requires a large amount of time for refining and is disadvantageous from the viewpoint of productivity.

One or More Elements Selected from Ti: 0.01% or More and 0.50% or Less, Nb: 0.01% or More and 0.20% or Less, V: 0.01% or More and 0.20% or Less, Zr: 0.005% or More and 0.200% or Less, and Hf: 0.005% or More and 0.200% or Less The ferritic stainless steel foil according to aspects of the present invention may contain one or more elements selected from Ti, Nb, V, Zr, and Hf in order to increase the proportion of the area of {111} crystal grains on the surface of the foil, promote the growth of whiskers, enhance the oxidation resistance of the foil, and increase the productivity of the foil by improving the toughness of the foil.

Ti: 0.01% or More and 0.50% or Less

Ti is an element that stabilizes C and N contained in the steel and thereby increases the area proportion of {111} crystal grains on the surface of the foil. Ti is also an element that promotes the growth of whiskers. Furthermore, Ti increases the adhesion between an Al oxide layer formed on the surface of the foil and the base iron. Such effects may be achieved by limiting the Ti content to be 0.01% or more. However, since Ti is easily oxidized, a large amount of Ti oxide mixes in an Al oxide layer formed on the surface of the foil, if the content of Ti exceeds 0.50%. If a large amount of Ti oxide mixes in the Al oxide layer, the oxidation resistance of the foil is degraded. Thus, in the case where the foil contains Ti, the Ti content is preferably limited to be 0.01% or more and 0.50% or less and is more preferably set to 0.05% or more and 0.30% or less.

Nb: 0.01% or More and 0.20% or Less

Nb is an element that stabilizes C and N contained in the steel and thereby increases the area proportion of {111} crystal grains on the surface of the foil. Nb is also an element that promotes the growth of whiskers. Such effects may be achieved by limiting the Nb content to be 0.01% or more. However, since Nb is easily oxidized, a large amount of Nb oxide mixes in an Al oxide layer formed on the surface of the foil, if the content of Nb exceeds 0.20%. If a large amount of Nb oxide mixes in the Al oxide layer, the oxidation resistance of the foil is degraded. Thus, in the case where the foil contains Nb, the Nb content is preferably limited to be 0.01% or more and 0.20% or less and is more preferably set to 0.05% or more and 0.10% or less.

V: 0.01% or More and 0.20% or Less

V is an element that stabilizes C and N contained in the steel and thereby increases the area proportion of {111} crystal grains on the surface of the foil. V is also an element that promotes the growth of whiskers. Such effects may be achieved by limiting the V content to be 0.01% or more. However, since V is easily oxidized, a large amount of V oxide mixes in an Al oxide layer formed on the surface of the foil, if the content of V exceeds 0.20%. If a large amount of V oxide mixes in the Al oxide layer, the oxidation resistance of the foil is degraded. Thus, in the case where the foil contains V, the V content is preferably limited to be 0.01% or more and 0.20% or less and is more preferably set to 0.05% or more and 0.10% or less.

Zr: 0.005% or More and 0.200% or Less

Zr is an element that combines with C and N contained in the steel and thereby increases the area proportion of {111} crystal grains on the surface of the foil. Zr is also an element that promotes the growth of whiskers. Furthermore, Zr concentrates at crystal grain boundaries in an Al oxide layer formed on the surface of the foil, thereby enhancing the oxidation resistance of the foil, increases the strength of the foil at high temperatures, and enhances the stability of the shape of the foil. Such effects may be achieved by limiting the Zr content to be 0.005% or more. However, if the Zr content exceeds 0.200%, Zr forms intermetallic compounds together with Fe and the like, which deteriorate the oxidation resistance of the foil. Thus, in the case where the foil contains Zr, the Zr content is preferably limited to be 0.005% or more and 0.200% or less and is more preferably set to 0.010% or more and 0.050% or less.

Hf: 0.005% or More and 0.200% or Less

Hf is an element that combines with C and N contained in the steel and thereby increases the area proportion of {111} crystal grains on the surface of the foil. Hf is also an element that promotes the growth of whiskers. Furthermore, Hf is effective to increase the adhesion between an Al oxide layer formed on the surface of the foil and the base iron. In addition, Hf reduces the growth rate of the Al oxide layer and thereby restrain a decrease in the Al content in the steel. Thus, Hf is also effective to enhance the oxidation resistance of the foil. The above effects may be achieved by limiting the Hf content to be 0.005% or more. However, if the Hf content exceeds 0.200%, Hf mixes in the above Al oxide layer in the form of $HfO_2$, which serves as a path through which oxygen diffuses. This conversely accelerates oxidation and enhances the rate of decrease in the Al content in the steel. Thus, in the case where the foil contains Hf, the Hf content is preferably limited to be 0.005% or more and 0.200% or less and is more preferably set to 0.010% or more and 0.100% or less.

The above-described elements are fundamental constituents of the ferritic stainless steel foil according to aspects of the present invention. Optionally, the ferritic stainless steel foil according to aspects of the present invention may further contain, in addition to the above fundamental constituents, one or more elements selected from Ni: 0.01% or more and 0.50% or less, Cu: 0.01% or more and 1.00% or less, Mo: 0.01% or more and 4.00% or less, and W: 0.01% or more and 4.00% or less such that the total content of these elements is 6.0% or less.

Ni: 0.01% or More and 0.50% or Less

Ni is effective to enhance the brazability of the foil with which the foil can be formed into a catalyst carrier having a desired structure. In order to achieve the above effect, the Ni content is preferably set to 0.01% or more. However, if the content of Ni, which is an austenite-stabilization element, exceeds 0.50%, the austenite microstructure may be formed when Al and Cr contained in the foil are consumed due to the oxidation. Formation of the austenite microstructure increases the thermal expansion coefficient of the foil and causes defects such as necking and rupturing of the foil. Thus, in the case where the foil contains Ni, the Ni content is preferably set to 0.01% or more and 0.50% or less, is more preferably set to 0.05% or more and 0.30% or less, and is further preferably set to 0.10% or more and 0.20% or less.

Cu: 0.01% or More and 1.00% or Less

Cu is effective to increase the high-temperature strength of the foil. In order to achieve this effect, the Cu content is preferably set to 0.01% or more. However, a Cu content exceeding 1.00% may deteriorate the toughness of the hot-rolled sheet and make it difficult to produce the foil. Thus, in the case where the foil contains Cu, the Cu content is preferably set to 0.01% or more and 1.00% or less and is more preferably set to 0.01% or more and 0.50% or less.

Mo: 0.01% or More and 4.00% or Less

Mo is effective to increase the high-temperature strength of the foil. In order to achieve this effect, the Mo content is preferably set to 0.01% or more. However, a Mo content exceeding 4.00% may deteriorate the toughness of the hot-rolled sheet and the cold-rolled sheet and consequently make it difficult to produce the foil. Thus, in the case where the foil contains Mo, the Mo content is preferably set to 0.01% or more and 4.00% or less and is more preferably set to 1.50% or more and 2.50% or less.

W: 0.01% or More and 4.00% or Less

W is effective to increase the high-temperature strength of the foil. In order to achieve this effect, the W content is preferably set to 0.01% or more. However, a W content exceeding 4.00% may deteriorate the toughness of the hot-rolled sheet and the cold-rolled sheet and consequently make it difficult to produce the foil. Thus, in the case where the foil contains W, the W content is preferably set to 0.01% or more and 4.00% or less and is more preferably set to 1.50% or more and 2.50% or less.

Total Content of Ni, Cu, Mo, and W: 6.0% or Less

In the case where the ferritic stainless steel foil according to aspects of the present invention contains one or more elements selected from Ni, Cu, Mo, and W, the total content of these elements is preferably set to 6.0% or less. If the total content of these elements exceeds 6.0%, the toughness of the hot-rolled sheet and cold-rolled sheet may be significantly degraded and, as a result, it may become difficult to produce the foil. The total content of these elements is more preferably set to 4.0% or less.

Optionally, the ferritic stainless steel foil according to an aspect of the present invention may contain one or more elements selected from Ca: 0.0005% or more and 0.0200% or less, Mg: 0.0002% or more and 0.0200% or less, and REM: 0.010% or more and 0.200% or less.

Ca: 0.0005% or More and 0.0200% or Less

Ca is effective to increase the adhesion between an Al oxide layer formed on the surface of the foil and the base iron. In order to achieve the effect, the Ca content is preferably set to 0.0005% or more. However, a Ca content exceeding 0.0200% excessively may increases the rate of oxidation and deteriorate the oxidation resistance of the foil. Thus, in the case where the foil contains Ca, the Ca content is preferably set to 0.0005% or more and 0.0200% or less and is more preferably set to 0.0020% or more and 0.0100% or less.

Mg: 0.0002% or More and 0.0200% or Less

Similarly to Ca, Mg is effective to increase the adhesion between an Al oxide layer formed on the surface of the foil and the base iron. In order to achieve the effect, the Mg content is preferably set to 0.0002% or more. However, a Mg content exceeding 0.0200% excessively may increases the rate of oxidation and deteriorate the oxidation resistance of the foil. Thus, in the case where the foil contains Mg, the Mg content is preferably set to 0.0002% or more and 0.0200% or less and is more preferably set to 0.0020% or more and 0.0100% or less.

REM: 0.010% or More and 0.200% or Less

REMs collectively refer to Sc, Y, and lanthanide-series elements (elements of atomic numbers 57 to 71, such as La, Ce, Pr, Nd, and Sm). The term "REM content" used herein refers to the total content of these elements. In general, REMs are effective to improve the adhesion property of an Al oxide layer formed on the surface of the foil, reduce the growth rate of the Al oxide layer (i.e., the rate of oxidation), and markedly enhance the oxidation resistance of the foil. In order to achieve the effects, the REM content is preferably set to 0.010% or more. However, if the REM content exceeds 0.200%, these elements concentrate at the crystal grain boundaries and melt when heated to a high temperature in the production of the foil, which may cause defects on the surface of a material of the foil, that is, a hot-rolled steel strip (i.e., hot-rolled sheet). Thus, in the case where the foil contains REMs, the REM content is preferably set to 0.010% or more and 0.200% or less and is more preferably set to 0.030% or more and 0.100% or less.

The elements contained in the ferritic stainless steel foil according to aspects of the present invention which are other than the above-described constituents (i.e., the balance) are Fe and inevitable impurities. Examples of the inevitable impurities include Zn and Sn. The contents of these elements are each preferably 0.1% or less.

The properties (i.e., microstructure and the thickness of the oxide layer) of the surface of the ferritic stainless steel foil according to aspects of the present invention are described below.

The features of the ferritic stainless steel foil according to an embodiment of the present invention are that, the proportion of {111} crystal grains on the surface of the foil is 50% by area or more, and that an oxide layer formed on the surface of the foil has a thickness of 0.1 μm or less. In an embodiment, the above conditions are essential for imparting a desired ability to form whiskers to the ferritic stainless steel foil. The term "ability of the foil to form whiskers" used herein refers to the likelihood of whiskers being grown by performing a whisker-forming heat treatment, that is, a heat treatment (heat treatment which holds the foil at a high temperature in an oxidizing atmosphere) for forming whiskers on the surface of the foil.

Proportion of {111} Crystal Grains on Surface of Foil: 50% by Area or More

As described above, when the foil is subjected to the whisker-forming heat treatment, whiskers grow at a higher rate on a portion of the surface of the foil on which {111} crystal grains are present than on a portion of the surface of the foil on which other crystal grains are present. Therefore, it is particularly effective to increase the area proportion of {111} crystal grains on the surface of the foil in order to enhance the ability of the foil to form whiskers. Accordingly, in an embodiment of the present invention, the proportion of {111} crystal grains on the surface of the foil is limited to be 50% by area or more in order to obtain the effect on enhancing the ability of the foil to form whiskers to a sufficient degree. In order to further enhance the ability of the foil to form whiskers, the proportion of {111} crystal grains is preferably set to 60% by area or more and is more preferably set to 70% by area or more.

Note that the term "{111} crystal grains" herein refers to crystal grains such that the difference between a direction perpendicular to the surface of the foil and {111} plane of the crystal grains is within ±15°.

Thickness of Oxide Layer on Surface of Foil: 0.1 μm or Less

If an oxide layer having a thickness of more than 0.1 μm is present on the surface of the foil that has not yet been subjected to the whisker-forming heat treatment, the oxide layer hinders the growth of whiskers. In such a case, whiskers are hardly formed on the foil even when, for example, the foil is subjected to a whisker-forming heat treatment in which the foil is held at a high temperature of 800° C. to 1000° C. for a predetermined amount of time in an oxidizing atmosphere. Therefore, in an embodiment of the present invention, the thickness of an oxide layer formed on the surface of the foil is limited to be 0.1 μm or less and is preferably set to 0.03 μm or less in order to impart an excellent ability to form whiskers to the foil.

Oxide layers that can be formed on the surface of the ferritic stainless steel foil according to aspects of the present invention are an Al oxide layer, a Fe oxide layer, a Cr oxide layer, and a Si oxide layer.

The presence of these oxide layers can be confirmed with known surface analyzers such as a glow discharge spectrometer (GDS). An example method in which an Al oxide layer is measured with a GDS by depth profiling is described below. In the case where an Al oxide layer is present on the surface of the foil, the detected Al intensity increases as the analysis proceeds in the depth direction starting from the surface of the foil (i.e., the surface of the oxide layer) and, after reaching its local maximum, decreases towards the interface beyond the oxide layer and the base iron. The detected Al intensity continues to reduce below the interface as the analysis proceeds and becomes substantially constant in inner part of the foil (i.e., the base-iron portion of the foil). When the Al concentration (i.e., the detected Al intensity) becomes constant, the point at which the detected Al intensity is equal to "(Local Maximum Intensity+Intensity Detected in Constant Region)×0.5" is defined to be the interface between the Al oxide layer and the base iron. The portion of the foil which lies on the surface side across the interface is defined to be the Al oxide layer. The thickness of the Al oxide layer is determined by converting the amount of time required to reach the interface between the Al oxide layer and the base iron by sputtering on the basis of the relationship between the amount of sputtering time and the thickness of the layer to be analyzed, which has been prepared using sample foils including an Al oxide layer having a known thickness. The thicknesses of oxide layers other than an Al oxide layer, such as a Fe oxide layer and a Cr oxide layer, is also measured in the above-described manner. The largest of the thicknesses of an Al oxide layer, a Fe oxide layer, a Cr oxide layer, and a Si oxide layer is regarded as the thickness of an oxide layer formed on the surface of the foil.

As described above, according to aspects of the present invention, controlling the composition of the foil and the properties (i.e., microstructure and the thickness of the oxide layer) of the surface of the foil enables a ferritic stainless steel foil having an excellent ability to form whiskers to be produced. Thus, using the foil according to an aspect of the present invention enables whiskers having a certain thickness, which have been formed by performing an oxidation treatment for about 24 hours in the related art, to be formed by performing an oxidation treatment for about 12 hours.

A preferable method for producing the ferritic stainless steel foil according to an aspect of the present invention is described below.

The ferritic stainless steel foil according to an aspect of the present invention is produced by, for example, hot-rolling a steel slab having the above-described composition, performing cold rolling one or more times, and performing annealing one or more times. The cold-rolling step is conducted at a final rolling reduction of 50% or more and 95% or less. The annealing treatment includes a finishing annealing treatment, which is performed at 800° C. or more and 1100° C. or less for 3 seconds or more and 25 hours or less in a low-oxygen atmosphere containing one or more gases selected from $N_2$, $H_2$, He, Ar, CO, and $CO_2$ and having a dew point of −20° C. or less or in a vacuum having a pressure of 1 Pa or less. Note that the term "final rolling reduction" refers to a rolling reduction at which the final cold-rolling step is conducted, and the term "finishing annealing" refers to the final annealing step.

For producing the ferritic stainless steel foil according to an embodiment of the present invention, ordinary stainless steel production equipment may be used. For example, a stainless steel having the above-described composition is produced with a converter, an electric furnace, or the like, subjected to secondary refining by VOD or AOD, and subsequently formed into a steel slab having a thickness of about 200 to 300 mm by ingot casting-slabbing or continuous casting. The cast slab is charged into a heating furnace, heated to 1150° C. to 1250° C., and subsequently hot-rolled. Thus, a hot-rolled sheet having a thickness of about 2 to 4 mm is prepared. Optionally, the hot-rolled sheet may be subjected to a hot-rolled-sheet annealing treatment at 800° C. to 1050° C. However, the hot-rolled-sheet annealing treatment is preferably omitted in order to increase the area proportion of {111} crystal grains on the surface of the final foil.

As described above, in order to increase the proportion of the area of {111} crystal grains on the surface of the final product of the foil, it is important to break a nonuniform microstructure formed by hot rolling in early stages of cold rolling to a sufficient degree and to introduce a large amount of strain caused by working to the foil before the foil is rolled to the thickness of the final product. For introducing a large amount of strain caused by working to the foil before the foil is rolled to the thickness of the final product, it is preferable to, subsequent to the hot-rolling step, omit the hot-rolled-sheet annealing treatment and perform cold rolling. Increasing the thickness of the hot-rolled sheet is also effective for introducing a large amount of strain caused by working to the foil.

The hot-rolled sheet prepared in the above-described manner is subjected to shot blasting, pickling, mechanical polishing, and the like in order to remove scales from the surface. Subsequently, the cycle of cold rolling and annealing is repeated, for example, a plurality of times. Thus, a stainless steel foil having a thickness of 200 μm or less is formed.

In the case where intermediate annealing is performed in the cold rolling step, the rolling reduction at which the hot-rolled sheet after the hot rolling step is cold-rolled before the intermediate annealing being conducted is preferably limited to be 50% or more and 95% or more or less and is more preferably set to 60% or more and 95% or less. This enables a nonuniform microstructure formed by hot rolling to be broken to a sufficient degree and to increase the area proportion of {111} crystal grains on the surface of the final foil.

In the above case where intermediate annealing is performed in the cold rolling step, the rolling reduction at which the cold-rolled sheet that has been subjected to the final intermediate annealing treatment is rolled to a desired foil thickness, that is, the rolling reduction (final rolling reduction) at which the final cold-rolling step is conducted in order to roll the cold-rolled sheet to a desired thickness of the final foil, is preferably limited to be 50% or more and 95% or less and is more preferably set to 60% or more and 95% or less. Limiting the final rolling reduction to be 50% or more and 95% or less enables a large amount of strain caused by working to be introduced to the foil. More preferably, the final rolling reduction is set to 70% or more and 95% or less. When the foil in which strain caused by working is accumulated to a sufficient degree is subjected to the finishing annealing treatment described below, recrystallization is promoted and the area proportion of {111} crystal grains on the surface of the final foil is further increased.

The above-described intermediate annealing treatment is preferably performed by holding the cold-rolled sheet at 700° C. or more and 1000° C. or less for 30 seconds or more and 5 minutes or less in a reducing atmosphere.

The thickness of the foil may be changed depending on the application of the foil. For example, in the case where the foil is used as a material of a catalyst carrier for exhaust gas purifying facilities which is particularly required to have high vibration resistance and high durability, the thickness of the foil is preferably set to about more than 100 μm and 200 μm or less. In the case where the foil is used as a material of a catalyst carrier for exhaust gas purifying facilities which is particularly required to have a high cell density and a low back pressure, the thickness of the foil is preferably set to about 25 μm or more and 100 μm or less.

In the above-described manner, the foil is rolled to a desired thickness and then subjected to finishing annealing, and recrystallization is subsequently performed. Thus, the final product (i.e., the ferritic stainless steel foil) is produced.

The finishing annealing treatment may be performed by holding the foil at 800° C. or more and 1100° C. or less for 3 seconds or more and 25 hours or less in a low-oxygen atmosphere or in a vacuum.

For limiting the thickness of an oxide layer formed on the surface of the foil that has been subjected to the finishing annealing treatment to be 0.1 μm or less, the annealing atmosphere in which the finishing annealing treatment is performed may be set to be a low-oxygen atmosphere containing one or more gases selected from $N_2$, $H_2$, He, Ar, CO, and $CO_2$ and having a dew point of −20° C. or less and preferably having a dew point of −30° C. or less or to be a vacuum having a pressure of 1 Pa or less.

If the finishing annealing treatment is performed at annealing temperature of being less than 800° C., recrystallization may fail to be promoted to a sufficient degree. On the other hand, if the annealing temperature exceeds 1100° C., the promotion effect of formation of whiskers may be saturated and the cost is increased. In addition, the yield strength of the foil is reduced, which may cause rupturing of the foil in the production line. The annealing temperature is preferably set to 800° C. or more and 1000° C. or less and is further preferably set to 850° C. or more and 950° C. or less. If the annealing time (amount of time for holding the foil at 800° C. or more and 1100° C. or less) in the finishing annealing treatment is less than 3 seconds, recrystallization may fail to be performed to a sufficient degree. On the other hand, If the heat treatment is performed for more than 25 hours, the promotion effect of formation of whiskers may be saturated and the cost is increased. The annealing time is preferably set to 30 seconds or more and 25 hours or less.

When the ferritic stainless steel foil is formed into a metal honeycomb, a bonding treatment such as brazing or diffusion bonding may be performed. In brazing and diffusion bonding, a heat treatment which holds the foil at, e.g., 800° C. to 1200° C. in a low-oxygen atmosphere or in a vacuum is performed. Therefore, the heat treatment may double as the above finishing annealing treatment by properly changing the conditions under which the heat treatment is performed.

By the above-described production method, a ferritic stainless steel foil having an excellent ability to form whiskers can be produced without introducing any additional step into the ordinary steps for producing a stainless steel foil.

The ferritic stainless steel foil produced in the above-described manner is subjected to a heat treatment which holds the foil at, e.g., 850° C. to 950° C. for 4 to 12 hours in an oxidizing atmosphere. The ferritic stainless steel foil that has been subjected to the above heat treatment may be used as a material of a catalyst carrier for exhaust gas purifying facilities.

The conditions under which the heat treatment for forming whiskers on the surface of the ferritic stainless steel foil according to the present invention (i.e., whisker-forming heat treatment) is performed are not limited. For example, the whisker-forming heat treatment is preferably performed by holding the foil at 800° C. or more and 1000° C. or less for 1 hour or more and 25 hours or less in an oxidizing atmosphere. The term "oxidizing atmosphere" used herein refers to an atmosphere having an oxygen concentration of about 1% or more and 25% or less by volume.

If the heat-treatment temperature of the whisker-forming heat treatment is less than 800° C. or more than 1000° C., phases other than the $\gamma$-$Al_2O_3$ phase may be formed and fail to form whiskers in shape. If the amount of heat-treatment time (i.e., the amount of time for holding the foil at 800° C. or more and 1000° C. or less) in the whisker-forming heat treatment is less than 30 seconds, the growth of whiskers may be insufficient. If the heat treatment is performed for more than 25 hours, the promotion effect of forming whiskers may be saturated and the cost is increased. It is preferable to set the heat-treatment temperature to 850° C. or more and 950° C. or less and the amount of heat treatment time to 4 hours or more and 12 hours or less from the view point of reducing the amount of heat-treatment time and the production cost. Since the ferritic stainless steel foil according to aspects of the present invention has an excellent ability to form whiskers, it is possible to form sufficient whiskers on the surface of the foil even in the case where the heat treatment time is significantly reduced compared with that (about 24 hours) set in the related art.

In the case where the ferritic stainless steel foil according to aspects of the present invention is used as a material of a catalyst carrier for exhaust gas purifying facilities, the above-described whisker-forming heat treatment step may be added to the steps for producing the catalyst carrier. This step may be conducted before or after the ferritic stainless steel foil is formed and bonded into a predetermined shape (e.g., honeycomb shape). That is, a ferritic stainless steel foil that has not yet been formed into a predetermined shape may be subjected to the whisker-forming heat treatment or, alternatively, a ferritic stainless steel foil that has been formed and bonded into a predetermined shape (e.g., honeycomb shape) may also be subjected to the whisker-forming heat treatment.

EXAMPLES OF THE EMBODIMENTS OF THE INVENTION

Example 1

In a vacuum melting furnace, 30 kg of steels having the chemical compositions described in Table 1 were each produced by melting. The resulting steel ingots were each heated to 1200° C. and subsequently hot-rolled at 900° C. or more and 1200° C. or less to form a hot-rolled sheet having a thickness of 3 mm. The hot-rolled sheets were each not annealed but only pickled and subsequently subjected to a (first) cold-rolling step to form a cold-rolled sheet having a thickness of 0.2 mm. The cold-rolled sheets were each subjected to intermediate annealing and again subjected to a (second) cold-rolling step to form a foil having a thickness of 50 μm. The final rolling reduction of the foils (i.e., the rolling reduction at which the process-annealed sheets were rolled to the final thickness of the foils, that is, 50 μm) was 75%. The intermediate annealing treatment was performed under the following annealing conditions: atmosphere gas: $N_2$ gas, annealing temperature: 900° C. (950° C. for the cold-rolled sheets prepared from Steel Nos. 2 and 10 to 14 in Table 1), the amount of time for holding the cold-rolled sheets at the annealing temperature: 1 minute. Note that, in Table 1, it was not possible to prepare a hot-rolled sheet from Steel No. 23 having an Al content of 8.9% and Steel No. 24 having a Cr content of 36.5% because cracking occurred in the ingots during hot rolling. It was not possible to prepare a foil from Steel No. 20 in Table 1 which had a C content of 0.065% because cracking occurred in the steel sheet during cold rolling. Steel No. 21 in Table 1, which did not contain any of Ti, Nb, V, Zr, and Hf, and Steel No. 22 having an Al content of 1.1% were Comparative Examples.

TABLE 1

| Steel | Chemical composition (mass %) | | | | | | | | | | |
|---|---|---|---|---|---|---|---|---|---|---|---|
| No. | C | Si | Mn | S | P | Cr | Al | N | Ti | Nb | V |
| 1 | 0.008 | 0.14 | 0.13 | 0.0020 | 0.023 | 20.1 | 5.7 | 0.014 | — | — | — |
| 2 | 0.012 | 0.14 | 0.13 | 0.0025 | 0.022 | 20.5 | 5.8 | 0.011 | 0.21 | 0.08 | — |
| 3 | 0.013 | 0.08 | 0.07 | 0.0012 | 0.023 | 19.8 | 5.4 | 0.010 | — | — | 0.08 |
| 4 | 0.008 | 0.13 | 0.12 | 0.0025 | 0.032 | 20.2 | 5.6 | 0.012 | — | — | — |
| 5 | 0.007 | 0.12 | 0.12 | 0.0021 | 0.031 | 20.0 | 5.7 | 0.010 | — | — | — |
| 6 | 0.010 | 0.10 | 0.15 | 0.0021 | 0.034 | 18.5 | 3.4 | 0.008 | — | — | — |

TABLE 1-continued

| | | | | | | | | | | | |
|---|---|---|---|---|---|---|---|---|---|---|---|
| 7 | 0.009 | 0.10 | 0.10 | 0.0014 | 0.038 | 18.4 | 3.2 | 0.014 | 0.22 | — | — |
| 8 | 0.006 | 0.07 | 0.11 | 0.0024 | 0.029 | 17.9 | 3.4 | 0.009 | — | — | — |
| 9 | 0.011 | 0.13 | 0.08 | 0.0022 | 0.038 | 18.0 | 3.5 | 0.007 | — | 0.06 | — |
| 10 | 0.006 | 0.14 | 0.11 | 0.0011 | 0.031 | 18.3 | 3.6 | 0.008 | — | — | — |
| 11 | 0.013 | 0.12 | 0.12 | 0.0013 | 0.030 | 20.5 | 5.4 | 0.011 | — | — | 0.10 |
| 12 | 0.013 | 0.10 | 0.11 | 0.0013 | 0.037 | 25.2 | 5.8 | 0.009 | — | — | — |
| 13 | 0.011 | 0.11 | 0.13 | 0.0010 | 0.039 | 28.9 | 5.1 | 0.008 | — | — | — |
| 14 | 0.007 | 0.10 | 0.10 | 0.0015 | 0.030 | 15.4 | 5.0 | 0.013 | — | — | — |
| 15 | 0.013 | 0.10 | 0.22 | 0.0022 | 0.025 | 21.1 | 6.1 | 0.007 | — | — | — |
| 16 | 0.012 | 0.13 | 0.10 | 0.0015 | 0.026 | 20.9 | 2.7 | 0.010 | — | — | — |
| 17 | 0.006 | 0.15 | 0.12 | 0.0018 | 0.029 | 19.8 | 5.0 | 0.008 | — | — | — |
| 18 | 0.011 | 0.10 | 0.14 | 0.0021 | 0.025 | 20.0 | 3.0 | 0.013 | — | — | — |
| 19 | 0.007 | 0.19 | 0.16 | 0.0013 | 0.021 | 20.2 | 5.5 | 0.007 | 0.24 | — | — |
| 20 | 0.065 | 0.09 | 0.14 | 0.0014 | 0.034 | 20.1 | 5.4 | 0.012 | — | — | — |
| 21 | 0.010 | 0.10 | 0.14 | 0.0015 | 0.031 | 20.9 | 5.6 | 0.013 | — | — | — |
| 22 | 0.010 | 0.09 | 0.13 | 0.0020 | 0.035 | 20.0 | 1.1 | 0.007 | — | — | — |
| 23 | 0.008 | 0.24 | 0.12 | 0.0021 | 0.025 | 20.1 | 8.9 | 0.013 | — | — | — |
| 24 | 0.009 | 0.12 | 0.11 | 0.0020 | 0.037 | 36.5 | 5.8 | 0.013 | — | — | — |

| Steel | Chemical composition (mass %) | | | | | | |
|---|---|---|---|---|---|---|---|
| No. | Zr | Hf | REM | Ni | Cu | Others | Remark |
| 1 | 0.03 | — | La: 0.074 | 0.12 | 0.02 | — | Invention example |
| 2 | — | — | La: 0.082 | — | — | — | Invention example |
| 3 | — | 0.04 | La: 0.112 | 0.12 | 0.13 | — | Invention example |
| 4 | 0.03 | — | — | — | — | — | Invention example |
| 5 | 0.05 | — | — | 0.15 | 0.05 | Ca: 0.0045, Mg: 0.0032 | Invention example |
| 6 | 0.15 | — | La: 0.074 | 0.13 | 0.06 | — | Invention example |
| 7 | — | 0.08 | La: 0.088 | — | — | — | Invention example |
| 8 | 0.05 | — | La: 0.042, Nd: 0.025 | 0.10 | 0.91 | — | Invention example |
| 9 | — | — | La: 0.069 | 0.16 | 0.05 | — | Invention example |
| 10 | 0.05 | — | La: 0.074 | 0.13 | 0.05 | Ca: 0.0034, Mg: 0.0086 | Invention example |
| 11 | 0.04 | — | — | 0.12 | — | Mo: 2.4 | Invention example |
| 12 | 0.11 | — | La: 0.099 | — | 0.34 | Mo: 1.8 | Invention example |
| 13 | 0.05 | — | La: 0.084 | 0.20 | 0.51 | W: 2.5 | Invention example |
| 14 | 0.04 | — | La: 0.071 | 0.18 | 0.81 | Mo: 2.4, W: 1.1 | Invention example |
| 15 | 0.05 | — | Y: 0.035 | 0.12 | 0.53 | — | Invention example |
| 16 | 0.03 | — | La: 0.037, Ce: 0.044 | — | — | — | Invention example |
| 17 | 0.03 | — | — | 0.10 | 0.34 | Ca: 0.0051, Mg: 0.0052 | Invention example |
| 18 | 0.05 | — | — | 0.16 | 0.06 | Ca: 0.0045, Mg: 0.0041 | Invention example |
| 19 | — | — | — | — | — | — | Invention example |
| 20 | 0.03 | — | La: 0.098 | 0.16 | 0.05 | — | Comparative example |
| 21 | — | — | — | — | — | — | Comparative example |
| 22 | 0.04 | — | La: 0.083 | — | 0.05 | — | Comparative example |
| 23 | 0.03 | — | La: 0.061 | 0.13 | 0.06 | — | Comparative example |
| 24 | 0.04 | — | La: 0.081 | 0.15 | 0.06 | — | Comparative example |

The underlined values are out of the preferred range of the present invention.

The foils having a thickness of 50 μm prepared in the above-described manner were each subjected to a finishing annealing treatment. The finishing annealing treatment was performed under the following annealing conditions: atmosphere: 25 vol % $H_2$+75 vol % $N_2$ gas having a dew point of −35° C., annealing temperature: 900° C. (950° C. for the foils prepared from Steel Nos. 2 and 10 to 14 in Table 1), the amount of time for holding the foils at the annealing temperature: 1 minute.

The thickness of an oxide layer formed on the surface of each of the foils that had been subjected to the finishing annealing treatment was measured. The thicknesses of the oxide layers were measured by the above-described method in which a glow discharge spectrometer (GDS) was employed. The results of the measurement confirmed that the thicknesses of the oxide layers formed on the surfaces of the foils were all 0.01 μm or less.

The crystallographic orientation of grains present in the surface of each of the foils that had been subjected to the finishing annealing treatment was measured and evaluated. Subsequently, the foils that had been subjected to the finishing annealing treatment were each subjected to a whisker-forming heat treatment which holds the foil at 925° C. for 12 hours in the air, and the thickness of the whiskers formed on the surface of the resulting foil was measured in order to evaluate the ability of the foil to form whiskers. The measurements and evaluations were conducted as described below.

(1) Crystallographic Orientation of Grains Present in Surface of Foil

The crystallographic orientations of grains present in the surfaces of the foils were measured by electron backscatter diffraction (EBSD). A specimen having a size of 15 mm×15 mm was cut from each of the foils that had been subjected to the finishing annealing treatment, and the crystallographic orientation of grains present in the surface of the foil was measured by EBSD in a region which had a size of 1 mm in a direction perpendicular to the rolling direction×3 mm in the rolling direction. The crystallographic orientations of grains present in the surfaces of the foils were evaluated as "Excellent (⊙)" when the proportion of {111} crystal grains was 70% by area or more, as "Good (○)" when the proportion of {111} crystal grains was 50% by area or more and less than 70% by area, and as "Poor (×)" when the proportion of {111} crystal grains was less than 50% by area. Note that the term "{111} crystal grains" used herein refers to crystal grains such that the difference between {111} plane of the crystal grains and a direction perpendicular to the surface of the foil is within ±15°.

(2) Ability to Form Whiskers

The foils that had been subjected to the finishing annealing treatment were each cut into a specimen having a width of 20 mm and a length of 30 mm. The specimens were each subjected to a heat treatment in the air under the following conditions: annealing temperature: 925° C., the amount of time for holding the specimens at the annealing temperature: 12 hours.

After the heat treatment had been completed, the surface of each specimen was observed with a scanning electron microscope (SEM) in order to confirm the formation of whiskers. The specimens on which the formation of whiskers was confirmed were each cut and buried in a resin such that a cross section of the specimen which was parallel to the width direction of the specimen was exposed. The exposed cross section of the specimen was polished and subsequently observed with a SEM. Thus, the thickness of whiskers formed on the specimen was measured.

The average thickness of whiskers formed on each foil was determined by measuring the thickness of whiskers formed on the foil (i.e., the distance between the surface of the foil and the edges of the whiskers) at 10 positions on a 1-mm segment extending in the width direction of the specimen at intervals of 0.1 mm and taking the averages thereof. The abilities of the foils to form whiskers were evaluated as "Excellent (⊙)" when the average thickness of whiskers formed on the foil was 0.50 μm or more, as "Good (○)" when the average thickness of whiskers formed on the foil was 0.25 μm or more and less than 0.50 μm, and as "Poor (×)" when the average thickness of whiskers formed on the foil was less than 0.25 μm.

Table 2 shows the results of the above evaluations.

TABLE 2

| | | {111} Crystal grains on surface of foil | | Ability to form whiskers | | |
|---|---|---|---|---|---|---|
| Foil | Steel No. | Area proportion (%) | Evaluation | Average thickness of formed whiskers (μm) | Evaluation | Remark |
| A | 1 | 65 | ○ | 0.45 | ○ | Invention example |
| B | 2 | 75 | ⊙ | 0.61 | ⊙ | Invention example |
| C | 3 | 60 | ○ | 0.58 | ⊙ | Invention example |
| D | 4 | 73 | ⊙ | 0.70 | ⊙ | Invention example |
| E | 5 | 70 | ⊙ | 0.33 | ○ | Invention example |
| F | 6 | 62 | ○ | 0.37 | ○ | Invention example |
| G | 7 | 62 | ○ | 0.41 | ○ | Invention example |
| H | 8 | 67 | ○ | 0.29 | ○ | Invention example |
| I | 9 | 68 | ○ | 0.36 | ○ | Invention example |
| J | 10 | 70 | ⊙ | 0.42 | ○ | Invention example |
| K | 11 | 71 | ⊙ | 0.84 | ⊙ | Invention example |
| L | 12 | 73 | ⊙ | 0.67 | ⊙ | Invention example |
| M | 13 | 70 | ⊙ | 0.79 | ⊙ | Invention example |
| N | 14 | 74 | ⊙ | 0.87 | ⊙ | Invention example |
| O | 15 | 68 | ○ | 0.69 | ⊙ | Invention example |
| P | 16 | 67 | ○ | 0.33 | ○ | Invention example |
| Q | 17 | 71 | ⊙ | 0.41 | ○ | Invention example |
| R | 18 | 64 | ○ | 0.27 | ○ | Invention example |
| S | 19 | 73 | ⊙ | 0.53 | ⊙ | Invention example |
| T | 20 | Cold rolling could not be performed | | | | Comparative example |
| U | 21 | 58 | ○ | 0.08 | X | Comparative example |
| V | 22 | 63 | ○ | Whiskers were not generated | X | Comparative example |
| W | 23 | Hot rolling could not be performed | | | | Comparative example |
| X | 24 | Hot rolling could not be performed | | | | Comparative example |

The underlined values are out of the preferred range of the present invention.

As shown in Table 2, it is confirmed that the foils (A to S) prepared in Invention Examples had an excellent ability to form whiskers. In contrast, whiskers were not formed on the foils (U and V) prepared in Comparative Examples, which had a composition that was not within the preferred range of the present invention, although the proportion of {111} crystal grains was 50% by area or more.

Example 2

The influence of production conditions (the implementation of the hot-rolled-sheet annealing treatment, the final rolling reduction in cold rolling, and the annealing atmosphere in finishing annealing) on the crystallographic orientation of grains present in the surface of the foil and the thickness of an oxide layer formed on the surface of the foil were investigated by using the hot-rolled sheets having a thickness of 3 mm which were prepared from Steel Nos. 1, 6, 11, and 19 in Example 1. The hot-rolled sheets described above were each pickled and subjected to a (first) cold rolling step, intermediate annealing, and a (second) cold-rolling step in this order to form a foil having a thickness of 50 μm.

Some of the hot-rolled sheets were each subjected to the hot-rolled-sheet annealing treatment, then pickled in order to remove scales, and subjected to a (first) cold rolling step, intermediate annealing, and a (second) cold-rolling step in this order to form a foil having a thickness of 50 μm.

Some of the hot-rolled sheets were each pickled, then subjected to the hot-rolled-sheet annealing treatment, again pickled in order to remove scales, and subjected to a (first) cold rolling step, intermediate annealing, a (second) cold rolling step, intermediate annealing, and a (third) cold-rolling step in this order to form a foil having a thickness of 50 μm.

The hot-rolled-sheet annealing treatment was performed under the following annealing conditions: annealing temperature: 900° C. or 950° C., amount of annealing time (i.e., the amount of time for holding the hot-rolled sheet at the annealing temperature): 1 minute.

The thicknesses of the cold-rolled sheets before being subjected to the final intermediate annealing treatment were each set to any one of five levels of 0.5 mm, 0.3 mm, 0.1 mm, 0.09 mm, and 0.08 mm. The cold-rolled sheets that had been subjected to the final intermediate annealing treatment were each rolled to the final foil thickness (50 μm) at a different rolling reduction (i.e., final rolling reduction). The intermediate annealing treatment was performed under the following conditions: atmosphere gas: $N_2$ gas, annealing temperature: 900° C. for Steel Nos. 1, 6, and 19 and 950° C. for Steel No. 11, the amount of time for holding the foils at the annealing temperature: 1 minute.

Table 3 shows the status of the implementation of hot-rolled-sheet annealing of each hot rolled sheet, the thickness of each cold-rolled sheet before being subjected to the intermediate annealing treatment, and the final rolling reduction of each cold-rolled sheet.

The foils having a thickness of 50 μm prepared in the above-described manner were each subjected to a finishing annealing treatment. Table 3 shows the annealing conditions (i.e., annealing temperatures, the amounts of time for holding the foils at the respective annealing temperatures, and annealing atmospheres) under which the finishing annealing treatment was performed.

The thickness of an oxide layer formed on the surface of each of the foils that had been subjected to the finishing annealing treatment was measured. The crystallographic orientation of grains present in the surface of each of the foils that had been subjected to the finishing annealing treatment was also measured and evaluated. Subsequently, the foils that had been subjected to the finishing annealing treatment were further subjected to a whisker-forming heat treatment in which the foils were held at 925° C. for 12 hours in the air. The average thickness of whiskers formed on the surface of each of the resulting foils was determined and the ability of the foil to form whiskers was evaluated. The measurement of the thicknesses of the oxide layers formed on the surfaces of the foils, the measurement and evaluation of crystallographic orientations, the measurement of the average thicknesses of whiskers, and the evaluation of abilities to form whiskers were conducted as in Example 1. Table 3 shows the results of the above measurements and evaluations.

TABLE 3

| | | | Cold rolling conditions | | Finish anneaing conditions | | |
|---|---|---|---|---|---|---|---|
| Foil | Steel No. | Hot-rolled sheet annealing | Thickness in process annealing (mm) | Final rolling reduction (%) | Annealing temperature (° C.) | Holding time (sec) | Atmosphere |
| AA | 1 | None | 0.5 | 90 | 900 | 30 | Vacuum having pressure of $2 \times 10^{-3}$ Pa |
| AB | 1 | None | 0.3 | 83 | 900 | 30 | Vacuum having pressure of $2 \times 10^{-3}$ Pa |
| AC | 1 | None | 0.3 | 83 | 900 | 30 | Vacuum having pressure of 0.8 Pa |
| AD | 1 | None | 0.1 | 50 | 900 | 30 | Vacuum having pressure of $2 \times 10^{-3}$ Pa |
| AE | 1 | 900° C. × 1 min | 0.3 | 83 | 900 | 30 | Vacuum having pressure of $2 \times 10^{-3}$ Pa |
| AF | 6 | None | 0.5 | 90 | 900 | 30 | 25 vol % $H_2$ + 75 vol % $N_2$, dew point: −35° C. |
| AG | 6 | None | 0.3 | 83 | 900 | 30 | 25 vol % $H_2$ + 75 vol % $N_2$, dew point: −35° C. |
| AH | 6 | None | 0.3 | 83 | 900 | 4 | 25 vol % $H_2$ + 75 vol % $N_2$, dew point: −23° C. |
| AI | 6 | None | 0.1 | 50 | 900 | 4 | 25 vol % $H_2$ + 75 vol % $N_2$, dew point: −35° C. |
| AJ | 6 | 900° C. × 1 min | 0.3 | 83 | 900 | 4 | 25 vol % $H_2$ + 75 vol % $N_2$, dew point: −35° C. |
| AK | 11 | None | 0.5 | 90 | 950 | 4 | 25 vol % $H_2$ + 75 vol % $N_2$, dew point: −35° C. |
| AL | 11 | None | 0.3 | 83 | 950 | 4 | 25 vol % $H_2$ + 75 vol % $N_2$, dew point: −35° C. |
| AM | 11 | None | 0.1 | 50 | 950 | 4 | 25 vol % $H_2$ + 75 vol % $N_2$, dew point: −35° C. |
| AN | 11 | 950° C. × 1 min | 0.3 | 83 | 950 | 4 | 25 vol % $H_2$ + 75 vol % $N_2$, dew point: −35° C. |
| AO | 19 | None | 0.5 | 90 | 900 | 4 | Vacuum having pressure of $2 \times 10^{-3}$ Pa |
| AP | 19 | None | 0.3 | 83 | 900 | 4 | Vacuum having pressure of $2 \times 10^{-3}$ Pa |
| AQ | 19 | None | 0.1 | 50 | 900 | 4 | Vacuum having pressure of $2 \times 10^{-3}$ Pa |
| AR | 19 | 900° C. × 1 min | 0.3 | 83 | 900 | 4 | Vacuum having pressure of $2 \times 10^{-3}$ Pa |
| BA | 1 | 900° C. × 1 min | 1st*1: 1.0<br>2nd*2: 0.08 | 38 | 900 | 4 | Vacuum having pressure of $2 \times 10^{-3}$ Pa |
| BB | 11 | 950° C. × 1 min | 1st*1: 1.0<br>2nd*2: 0.08 | 38 | 950 | 4 | 25 vol % $H_2$ + 75 vol % $N_2$, dew point: −35° C. |
| BC | 6 | None | 0.09 | 44 | 850 | 4 | 25 vol % $H_2$ + 75 vol % $N_2$, dew point: −35° C. |
| BD | 1 | None | 0.3 | 83 | 900 | 4 | Vacuum having pressure of 2.2 Pa |
| BE | 6 | None | 0.3 | 83 | 900 | 4 | 25 vol % $H_2$ + 75 vol % $N_2$, dew point: −15° C. |
| BF | 1 | None | 0.3 | 83 | 900 | 10 | Air |

TABLE 3-continued

| | | | | | | | |
|---|---|---|---|---|---|---|---|
| BG | 6 | None | 0.3 | 83 | 900 | 10 | Air |
| BH | 11 | None | 0.3 | 83 | 950 | 10 | Air |
| BI | 19 | None | 0.3 | 83 | 900 | 10 | Air |

| | | {111} Crystal grains on surface of foil | | Ability to form whiskers | | |
|---|---|---|---|---|---|---|
| Foil | Thickness of oxide layer on surface (μm) | Area proportion (%) | Evaluation | Average thickness of formed whiskers (μm) | Evaluation | Remark |
| AA | <0.01 | 75 | ⊙ | 1.03 | ⊙ | Invention example |
| AB | <0.01 | 71 | ⊙ | 0.64 | ⊙ | Invention example |
| AC | 0.06 | 73 | ⊙ | 0.38 | ○ | Invention example |
| AD | <0.01 | 64 | ○ | 0.35 | ○ | Invention example |
| AE | <0.01 | 55 | ○ | 0.26 | ○ | Invention example |
| AF | <0.01 | 74 | ⊙ | 1.10 | ⊙ | Invention example |
| AG | <0.01 | 69 | ○ | 0.58 | ⊙ | Invention example |
| AH | 0.08 | 64 | ○ | 0.33 | ○ | Invention example |
| AI | <0.01 | 59 | ○ | 0.37 | ○ | Invention example |
| AJ | <0.01 | 53 | ○ | 0.29 | ○ | Invention example |
| AK | <0.01 | 80 | ⊙ | 1.21 | ⊙ | Invention example |
| AL | <0.01 | 76 | ⊙ | 0.87 | ⊙ | Invention example |
| AM | <0.01 | 69 | ○ | 0.67 | ⊙ | Invention example |
| AN | <0.01 | 59 | ○ | 0.39 | ○ | Invention example |
| AO | <0.01 | 75 | ⊙ | 1.25 | ⊙ | Invention example |
| AP | <0.01 | 70 | ⊙ | 1.20 | ⊙ | Invention example |
| AQ | <0.01 | 61 | ○ | 0.89 | ⊙ | Invention example |
| AR | <0.01 | 52 | ○ | 0.51 | ⊙ | Invention example |
| BA | <0.01 | 36 | X | 0.05 | X | Comparative example |
| BB | <0.01 | 43 | X | 0.14 | X | Comparative example |
| BC | <0.01 | 20 | X | <0.10 | X | Comparative example |
| BD | 0.22 | 75 | ⊙ | Whiskers were not generated | X | Comparative example |
| BE | 0.12 | 66 | ○ | 0.11 | X | Comparative example |
| BF | 0.15 | 70 | ⊙ | Whiskers were not generated | X | Comparative example |
| BG | 0.28 | 67 | ○ | Whiskers were not generated | X | Comparative example |
| BH | 0.33 | 65 | ○ | Whiskers were not generated | X | Comparative example |
| BI | 0.47 | 73 | ⊙ | Whiskers were not generated | X | Comparative example |

*1Thickness of the cold-rolled sheet before being subjected to the first process anneaing treatment.
*2Thickness of the cold-rolled sheet before being subjected to the second process anneaing treatment.
The underlined values are out of the preferred range of the present invention.

As described in Table 3, in each of the foils prepared in Invention Examples, the proportion of {111} crystal grains on the surface of the foil was 50% by area or more and the thickness of an oxide layer formed on the surface of the foil was 0.1 μm or less, which shows that the foils prepared in Invention Examples had an excellent ability to form whiskers. A comparison of a ability to form whiskers among the group of foils prepared from the same steel under the same finishing annealing conditions at different final rolling reductions (i.e., the group of AA, AB, and AD, the group of AF, AG, and AI, the group of AK, AL, and AM, or the group of AO, AP, and AQ) indicates that, the higher the final rolling reduction, the larger the area proportion of {111} crystal grains on the surface of the foil and the higher the ability to form whiskers. Another comparison of a ability to form whiskers between the pair of foils prepared from the same steel at the same final rolling reductions under the same finishing annealing conditions with a different status of implementation of the hot-rolled-sheet annealing treatment (i.e., the pair of AB and AE, the pair of AG and AJ, the pair of AL and AN, or the pair of AP and AR) indicates that, in the case where the hot-rolled-sheet annealing treatment was not performed, the area proportion of {111} crystal grains on the surface of the foil was larger and the ability to form whiskers was higher than the case where the hot-rolled-sheet annealing treatment was performed.

In contrast, in the foils BA, BB, and BC prepared in Comparative Examples where the final rolling reduction was set to be low, the area proportion of {111} crystal grains on the surface of the foil was less than 50%. Thus, it was not possible to form whiskers to a sufficient degree. In the foils BD to BI prepared in Comparative Examples, the area proportion of {111} crystal grains on the surface of the foil was 50% or more, but a thick oxide layer having a thickness exceeding 0.1 μm was formed during the finishing annealing treatment. Therefore, it was not possible to form whiskers to a sufficient degree by performing a whisker-forming heat treatment subsequently.

According to the present invention, it is possible to produce a stainless steel foil having an excellent ability to form whiskers by using ordinary stainless steel production equipment with efficiency. This is advantageous from an industrial viewpoint.

The invention claimed is:

1. A ferritic stainless steel foil comprising a composition containing, by mass, C: 0.050% or less, Si: 2.00% or less, Mn: 0.50% or less, S: 0.010% or less, P: 0.050% or less, Cr: 15.0% or more and 30.0% or less, Al: 2.5% or more and 6.5% or less, N: 0.050% or less, one or more elements selected from Ti: 0.01% or more and 0.50% or less, Nb: 0.01% or more and 0.20% or less, V: 0.01% or more and 0.20% or less, Zr: 0.005% or more and 0.200% or less, and Hf: 0.005% or more and 0.200% or less, and the balance being Fe and inevitable impurities, a proportion of a {111} crystal grain on the surface of the foil being 60% by area or more, and thickness of an oxide layer formed on the surface of the foil being 0.1 μm or less, the {111} crystal grain being a crystal grain such that the difference between the {111} plane of the crystal grain and a direction perpendicular to the surface of the foil is within ±15°.

2. The ferritic stainless steel foil according to claim 1, wherein the composition further contains, by mass, one or more elements selected from Ni: 0.01% or more and 0.50% or less, Cu: 0.01 % or more and 1.00% or less, Mo: 0.01% or more and 4.00% or less, and W: 0.01% or more and 4.00% or less, the total content of the one or more elements being 6.0% or less.

3. The ferritic stainless steel foil according to claim 1, wherein the composition further contains, by mass, one or more elements selected from Ca: 0.0005% or more and 0.0200% or less, Mg: 0.0002% or more and 0.0200% or less, and REM: 0.010% or more and 0.200% or less.

4. The ferritic stainless steel foil according to claim 2, wherein the composition further contains, by mass, one or more elements selected from Ca: 0.0005% or more and 0.0200% or less, Mg: 0.0002% or more and 0.0200% or less, and REM: 0.010% or more and 0.200% or less.

5. A method for producing a ferritic stainless steel foil, the method comprising hot-rolling the slab containing a composition according to claim 1, performing cold rolling one or more times, and performing annealing one or more times, wherein a hot-rolled-sheet annealing treatment after the hot rolling and before the cold rolling is omitted, wherein the cold rolling is performed at a final rolling reduction of 50% or more and 95% or less, wherein the annealing includes finishing annealing which holds the foil at 800° C. or more and 1100° C. or less for 3 seconds or more and 25 hours or less in an atmosphere containing one or more gases selected from $N_2$, $H_2$, He, Ar, CO, and $CO_2$ and having a dew point of −20° C. or less or in a vacuum having a pressure of 1 Pa or less, and the final rolling reduction being a rolling reduction at which a final cold rolling is performed, and the finishing annealing being a final annealing.

6. A method for producing a ferritic stainless steel foil, the method comprising hot-rolling the slab containing a composition according to claim 2, performing cold rolling one or more times, and performing annealing one or more times, wherein the cold rolling is performed at a final rolling reduction of 50% or more and 95% or less, and wherein the annealing includes finishing annealing which holds the foil at 800° C. or more and 1100° C. or less for 3 seconds or more and 25 hours or less in an atmosphere containing one or more gases selected from $N_2$, $H_2$, He, Ar, CO, and $CO_2$ and having a dew point of −20° C. or less or in a vacuum having a pressure of 1 Pa or less, the final rolling reduction being a rolling reduction at which a final cold rolling is performed, and the finishing annealing being a final annealing.

7. A method for producing a ferritic stainless steel foil, the method comprising hot-rolling the slab containing a composition according to claim 3, performing cold rolling one or more times, and performing annealing one or more times, wherein the cold rolling is performed at a final rolling reduction of 50% or more and 95% or less, and wherein the annealing includes finishing annealing which holds the foil at 800° C. or more and 1100° C. or less for 3 seconds or more and 25 hours or less in an atmosphere containing one or more gases selected from $N_2$, $H_2$, He, Ar, CO, and $CO_2$ and having a dew point of −20° C. or less or in a vacuum having a pressure of 1 Pa or less, the final rolling reduction being a rolling reduction at which a final cold rolling is performed, and the finishing annealing being a final annealing.

8. A method for producing a ferritic stainless steel foil, the method comprising hot-rolling the slab containing a composition according to claim 4, performing cold rolling one or more times, and performing annealing one or more times, wherein the cold rolling is performed at a final rolling reduction of 50% or more and 95% or less, and wherein the annealing includes finishing annealing which holds the foil at 800° C. or more and 1100° C. or less for 3 seconds or more and 25 hours or less in an atmosphere containing one or more gases selected from $N_2$, $H_2$, He, Ar, CO, and $CO_2$ and having a dew point of −20° C. or less or in a vacuum having a pressure of 1 Pa or less, the final rolling reduction being a rolling reduction at which a final cold rolling is performed, and the finishing annealing being a final annealing.

* * * * *